US008746412B2

(12) United States Patent
Rebillard et al.

(10) Patent No.: US 8,746,412 B2
(45) Date of Patent: Jun. 10, 2014

(54) ELEVATOR DOOR FRAME WITH ELECTRONICS HOUSING

(75) Inventors: Pascal Rebillard, Gien (FR); Nicolas Fonteneau, Vitry Aux Loges (FR); Xavier Jean-Jacques Lejon, Loriet (FR)

(73) Assignee: Otis Elevator Company, Farmington, CT (US)

( * ) Notice: Subject to any disclaimer, the term of this patent is extended or adjusted under 35 U.S.C. 154(b) by 445 days.

(21) Appl. No.: 13/139,755

(22) PCT Filed: Dec. 19, 2008

(86) PCT No.: PCT/IB2008/003737

§ 371 (c)(1), (2), (4) Date: Jun. 15, 2011

(87) PCT Pub. No.: WO2010/070378

PCT Pub. Date: Jun. 24, 2010

(65) Prior Publication Data

US 2011/0253483 A1 Oct. 20, 2011

(51) Int. Cl.
*B66B 1/34* (2006.01)

(52) U.S. Cl.
USPC ..... 187/391; 187/314; 187/413; 187/336

(58) Field of Classification Search
USPC ..... 187/247, 276, 277, 314, 316, 317, 336, 187/340, 380, 391, 393, 395, 396, 337, 187/413; 49/12, 26, 28, 116; 52/127.8, 204
See application file for complete search history.

(56) References Cited

U.S. PATENT DOCUMENTS

| | | | | |
|---|---|---|---|---|
| 4,032,882 | A * | 6/1977 | Mandel et al. | 187/398 |
| 5,740,888 | A * | 4/1998 | Aulanko et al. | 187/336 |
| 5,889,241 | A * | 3/1999 | Zambelli et al. | 187/397 |
| 6,321,877 | B2 | 11/2001 | Yamakawa | |
| 6,336,523 | B1 * | 1/2002 | Ozeki et al. | 187/391 |
| 6,378,660 | B1 * | 4/2002 | Adifon et al. | 187/272 |
| 6,484,850 | B1 * | 11/2002 | Kobayashi et al. | 187/414 |
| 7,114,594 | B2 | 10/2006 | Rossignol et al. | |
| 7,398,861 | B2 * | 7/2008 | Rossignol et al. | 187/314 |
| 2012/0304550 | A1 * | 12/2012 | Teixeira Pinto Dias | 52/30 |
| 2012/0305337 | A1 * | 12/2012 | Hopp et al. | 187/336 |

FOREIGN PATENT DOCUMENTS

| | | |
|---|---|---|
| EP | 01294178 | 11/1989 |
| EP | 06191774 | 7/1994 |
| EP | 0680921 A2 | 11/1995 |

(Continued)

OTHER PUBLICATIONS

International Search Report and Written Opinion of the International Searching Authority for International application No. PCT/IB2008/003737 mailed Aug. 31, 2009.

(Continued)

*Primary Examiner* — Anthony Salata
(74) *Attorney, Agent, or Firm* — Carlson, Gaskey & Olds

(57) ABSTRACT

An exemplary enclosure for housing electronics useful with an elevator system includes a first sidewall and a second sidewall adjacent the first sidewall. A third sidewall is at an oblique angle relative to the first sidewall. The third sidewall provides a support surface for supporting electronics inside the enclosure. The first and second sidewalls are moveable relative to the third sidewall to provide a single opening facing the support surface.

28 Claims, 2 Drawing Sheets

(56) References Cited

FOREIGN PATENT DOCUMENTS

| | | | | |
|---|---|---|---|---|
| EP | 0698574 | A2 | | 2/1996 |
| EP | 0731053 | A2 | | 9/1996 |
| EP | 0884265 | A1 | | 12/1998 |
| EP | 0985626 | A2 | | 3/2000 |
| EP | 0985627 | A2 | | 3/2000 |
| EP | 1016614 | A1 | | 7/2000 |
| EP | 1081086 | A1 | | 3/2001 |
| EP | 1151952 | A2 | | 11/2001 |
| EP | 1314677 | A2 | | 5/2003 |
| EP | 1319626 | A1 | | 6/2003 |
| EP | 1524234 | A1 | | 4/2005 |
| JP | 54-43766 | | | 3/1979 |
| JP | 5633367 | | | 4/1981 |
| JP | 61203677 | | | 12/1986 |
| JP | 2127837 | A | | 5/1990 |
| JP | 06191774 | | | 7/1994 |
| JP | 11335011 | A | | 12/1999 |
| JP | 2000211864 | A | | 8/2000 |
| JP | 2003341965 | | | 12/2003 |
| JP | 2005298123 | A | | 10/2005 |
| JP | 2007119182 | A | * | 5/2007 |
| WO | 9623722 | | | 8/1996 |
| WO | 9741055 | | | 11/1997 |
| WO | 9814395 | | | 4/1998 |
| WO | 9832683 | | | 7/1998 |
| WO | 0174702 | | | 10/2001 |
| WO | 0192139 | | | 12/2001 |
| WO | 02098778 | A1 | | 12/2002 |
| WO | 03072478 | A1 | | 9/2003 |
| WO | 2004028946 | A1 | | 4/2004 |
| WO | 2004028951 | | | 4/2004 |
| WO | 2005000727 | A1 | | 1/2005 |
| WO | 2005040030 | A1 | | 5/2005 |
| WO | 2005042389 | A1 | | 5/2005 |
| WO | 2005082762 | A2 | | 9/2005 |
| WO | 2005085113 | | | 9/2005 |
| WO | 2005097652 | | | 10/2005 |
| WO | 2005121003 | A2 | | 12/2005 |
| WO | 2005123562 | A1 | | 12/2005 |
| WO | 2006006205 | | | 1/2006 |
| WO | 2006022007 | | | 3/2006 |
| WO | 2006112194 | | | 10/2006 |
| WO | 2006120283 | A1 | | 11/2006 |
| WO | 2006120721 | | | 11/2006 |
| WO | 2007028850 | A1 | | 3/2007 |
| WO | 2007034691 | | | 3/2007 |
| WO | 2008020111 | A1 | | 2/2008 |
| WO | 2008062509 | | | 5/2008 |
| WO | 2008068376 | A1 | | 6/2008 |

OTHER PUBLICATIONS

Chinese Search Report for Application No. 200880132473.X dated Apr. 22, 2013.

* cited by examiner

ELEVATOR DOOR FRAME WITH ELECTRONICS HOUSING

This application is a 371 of PCT/IB08/03737 Dec. 19, 2008.

BACKGROUND

Elevator systems require electronic components to control the desired operation of the elevator system. Drive and power electronics are used to control the power supplied to the elevator machine and the way in which the machine causes the elevator car to move. Control electronics are also used for inspection and maintenance procedures and passenger assistance such as emergency rescue operations. For many years such control electronics were kept in a machine room outside of the hoistway. More recently, it has become desirable to provide machine roomless elevator systems to eliminate the space requirements for providing a separate machine room. While there are advantages to such arrangements, they present new challenges.

One challenge associated with eliminating the machine room is finding a suitable location for the control electronics of the elevator system. Various approaches have been suggested. One approach shown in U.S. Pat. No. 7,114,594 includes supporting a control arrangement at the location of a doorframe for a hoistway door. The arrangement of that document includes an opening toward the interior of a hoistway and another opening facing outside the hoistway. The opening facing the inside of the hoistway is larger than the other to provide access to the control arrangement for a technician located in the hoistway. It is desirable to eliminate or minimize the amount of time an individual needs to be inside the hoistway for maintenance, inspection or other reasons. Another arrangement is shown in the Published Application WO 03/072478. That arrangement has the drawback of significantly increasing the size of a door surround.

SUMMARY

An exemplary enclosure for housing electronics useful with an elevator system includes a first sidewall. A second sidewall is adjacent the first sidewall. A third sidewall is at an oblique angle relative to the first sidewall. The third sidewall provides a support surface for supporting electronics inside the enclosure. The first and second sidewalls are moveable relative to the third sidewall to provide a single opening facing the support surface.

An exemplary elevator door frame assembly includes a header. A first jamb member is near a first end of the header. A second jamb member is near a second end of the header. The second jamb member includes an enclosure for supporting elevator system electronics. The enclosure includes a first sidewall, a second sidewall adjacent the first sidewall and a third sidewall that is obliquely oriented relative to the first sidewall. The first and second sidewalls are moveable relative to the third sidewall to provide a single access opening into the enclosure.

An exemplary elevator system includes an elevator car that is moveable within a hoistway. Doorways are positioned at landings along the hoistway. Each of the doorways has at least one door that is selectively open or closed to selectively provide access to the hoistway or the elevator car from the landing. At least one of the doorways includes an electronics enclosure that houses electronics that are configured to control movement of the elevator car. The electronics enclosure is located on one side of at least one of the doorways. The electronics enclosure includes a first sidewall, a second sidewall adjacent the first sidewall and a third sidewall that is obliquely oriented relative to the first sidewall. The first and second sidewalls are moveable relative to the third sidewall to provide a single access opening facing the third sidewall for allowing access to the electronics from a landing side of the doorway.

The various features and advantages of disclosed examples will become apparent to those skilled in the art from the following detailed description. The drawings that accompany the detailed description can be briefly described as follows.

DETAILED DESCRIPTION

Figure 1:
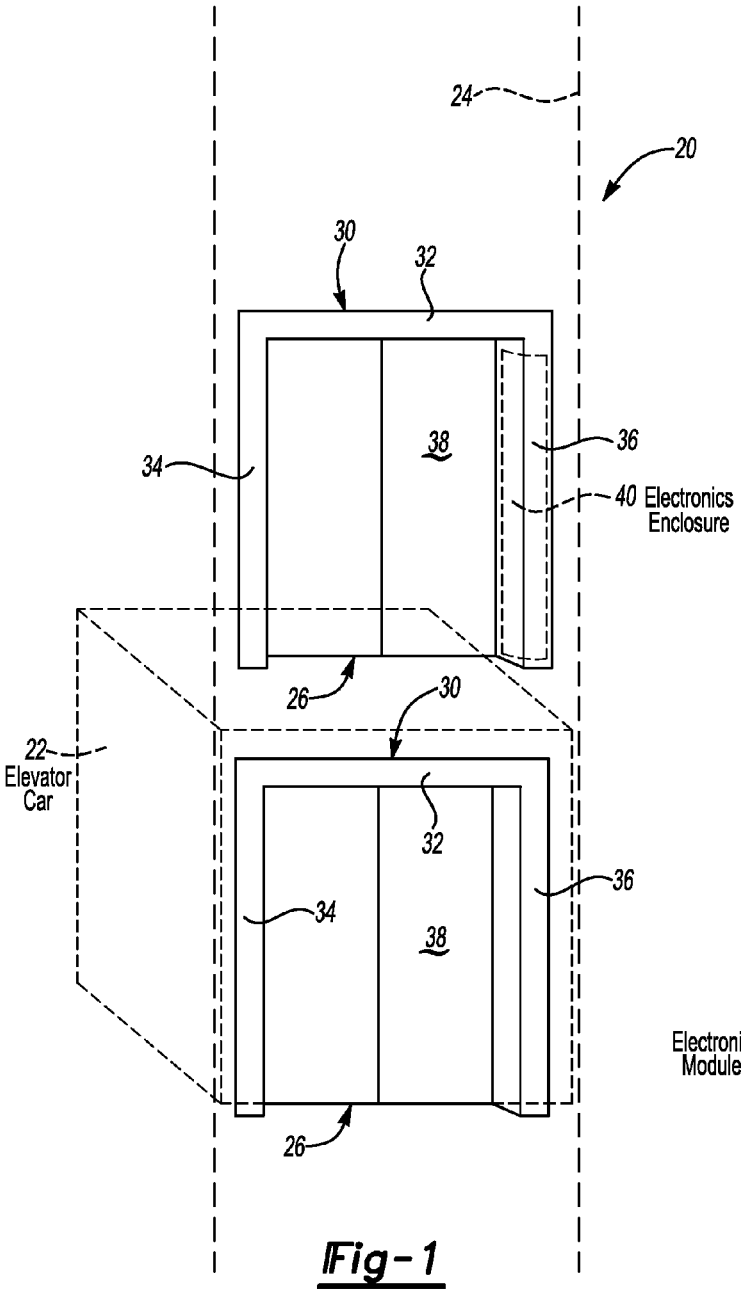
FIG. 1 schematically illustrates selected portions of an elevator system including an electronics enclosure designed according to an embodiment of this invention.

FIG. 1 schematically shows selected portions of an elevator system 20. An elevator car 22 is moveable within a hoistway 24. A plurality of landings 26 are positioned along the hoistway 24 to provide elevator service on a plurality of floors within a building, for example. In some cases, the elevator car 22 has doors on oppositely facing sides to provide service to landings on either side of the hoistway 24.

Each landing 26 includes a hoistway doorway 30 comprising a header 32, a first jamb member 34 and a second jamb member 36. The jamb members 34 and 36 are near opposite ends of the header 32. At least one door 38 is moveable between an open and a closed position to selectively provide access to the hoistway or the elevator car 22 if the elevator car is at the corresponding landing 26.

In the example of FIG. 1, at least one of the second jamb members 36 includes an electronics enclosure 40 for housing electronics that are useful for controlling operation of the elevator system 20 such as controlling movement of the elevator car. In this example, the enclosure 40 is incorporated into the door frame 30. Exterior surfaces of the enclosure 40 provide the exterior, finished surface of the doorway 30 when it is installed in a building.

Figure 2:
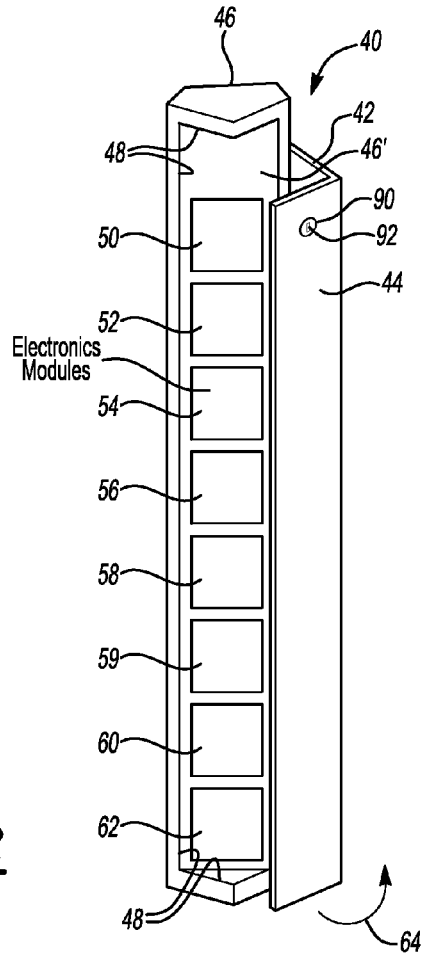
FIG. 2 diagrammatically illustrates an example electronics enclosure.

As shown in FIG. 2, an example enclosure 40 includes a first sidewall 42 and a second sidewall 44 that is generally perpendicular to the first sidewall 42. A third sidewall 46 is oriented at an oblique angle relative to the first sidewall 42 and the second sidewall 44. In this example, the third sidewall 46 is useful for mounting electronic components on a support surface 46' facing the interior of the enclosure 40. The first sidewall 42 and second sidewall 44 are selectively moveable relative to the third sidewall 46 to close off or expose an access opening 48 that allows an individual to have access to electronics within the enclosure 40. The access opening 48 is strategically arranged to be facing the landing side of the doorway 30 so that an individual standing at the landing 26 can have access to the electronics within the enclosure 40 without having to enter the elevator car 22 or the hoistway 24. The access opening 48 may extend along as much of the length of the jamb member 36 as is desired. In one example, the access opening 48 extends essentially from the header 32 to a floor at the landing 26.

The first sidewall 42 and second sidewall 44 are moveable relative to the third sidewall 46 to expose the access opening 48. Being able to move both of the first sidewall 42 and the second sidewall 44 allows for establishing a relatively wider access opening 48 compared to an opening provided by just one of those sidewalls. The two sidewall openings and the oblique orientation of the third sidewall 46 provides more convenient and effective access to any electronics within the enclosure 40.

In the example of FIG. 2, a variety of electronics are supported in the example enclosure 40. This example includes an electronics module 50 that is useful for inspection procedures for inspecting the elevator system 20. Another electronics module 52 is useful for maintenance procedures for the elevator system. A third electronics module 54 facilitates passenger assistance procedures to assist passengers of the elevator system. Such assistance operations may include an emergency rescue operation. Another electronics module 56 includes power control components such as fuses or electronics for regulating the power provided to the various portions of the elevator system 20. Another electronics module 58 comprises elevator drive components that are used for controlling operation of the machine (not illustrated) that is responsible for movement and position of the elevator car 22. Another module 59 includes the electronics typically associated with an elevator controller (or elevator group controller), i.e., the electronics used to receive hall calls and car calls, assign an elevator car to answer a hall call (if there are more than one elevator car in an elevator group), program the stops of each elevator car, open, reopen, and close the doors, monitor the safety chain, etc. The example of FIG. 2 includes another electronics module 60 that includes communication components for communications with a passenger inside the elevator car 22 or communications with other portions of the elevator system 20. A remote elevator monitoring module 62 is configured to communicate information regarding the elevator system to a remotely located device that is separate from the elevator system (e.g., a service center in another building). In one example, the remote elevator monitoring module 62 comprises Otis Elevator's REM product.

Having the ability to provide a variety of electronic components within the housing 40 and being able to access each of them from the landing side of the doorway 30 increases efficiency and reduces the requirement for an individual to enter the hoistway 24 to perform any procedures involving electronic components of the type housed within the enclosure 40.

Although schematically illustrated as distinct modules, those skilled in the art will realize that such example capabilities and control functions may be realized in different manners, depending on the design of the particular elevator system. Accordingly, any one or more of the above modules could be combined such as, for example, the inspection module 50 and the emergency operations module 54 could be combined into a joint emergency and inspection module. Similarly, the drive module 58 and the controller module 59 could be combined and/or the car communication module 60 and the remote elevator monitoring module 62 could be combined to facilitate enabling a remote technician to communicate directly with passengers in the car. The above description is intended to demonstrate how a wide variety of electronics and control components can be supported within the enclosure 40 and accessed through the single access opening 48.

Figure 3:
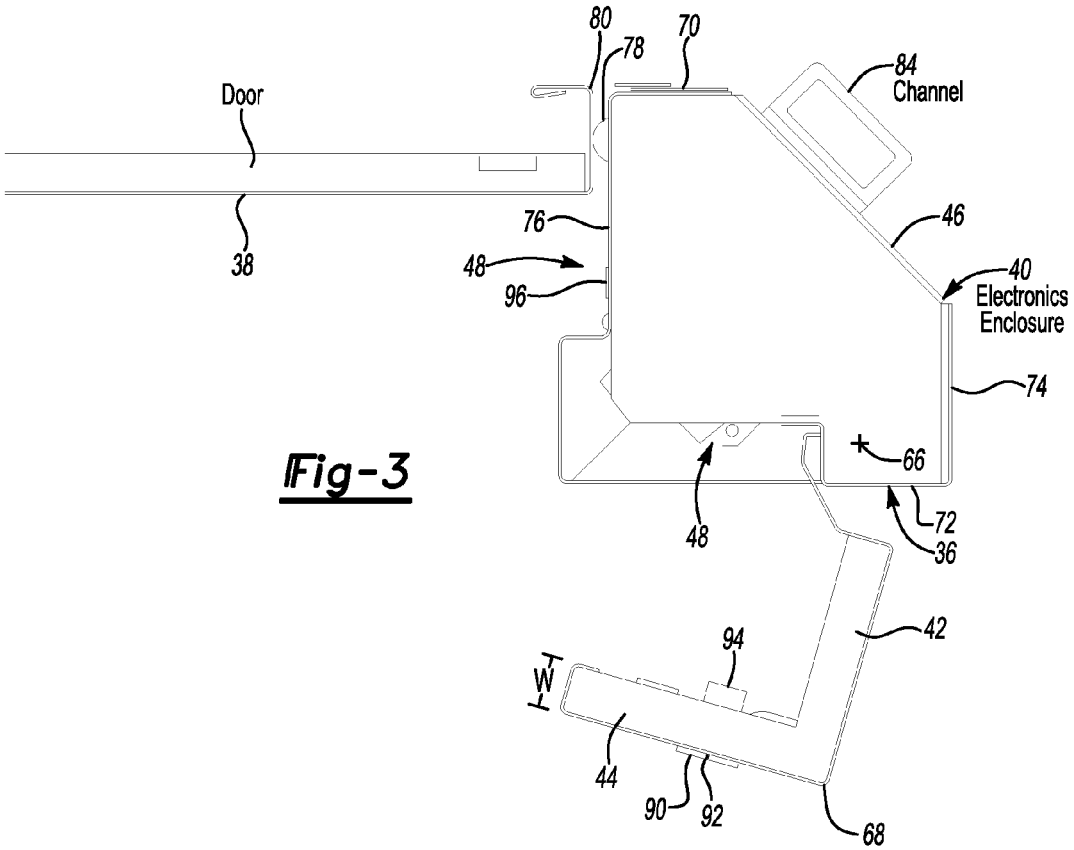
FIG. 3 is an end view of an example electronics enclosure in an open condition to provide access to electronics within the enclosure.
Figure 4:
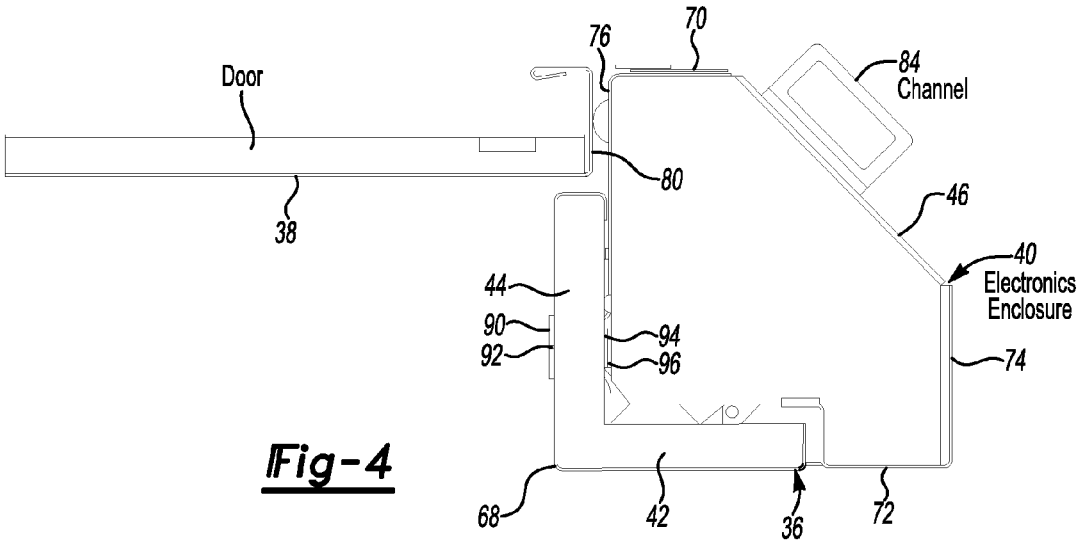
FIG. 4 shows the example of FIG. 3 when the enclosure is closed.

As can be appreciated from FIGS. 2-4, the access opening 48 is exposed by pivoting the first sidewall 42 and second sidewall 44 as shown by the arrow 64 about a pivot point 66 (shown in FIG. 3) relative to a remainder of the jamb member 36. In this example, the first sidewall 42 and second sidewall 44 are formed from a single piece of material. A corner 68 is at an interface between the two sidewalls. In one example, the sidewalls 42 and 44 comprise a single piece of metal that is bent into the configuration shown in the illustrations. It is also possible to have the first sidewall 42 and the second sidewall 44 moveable or flexible relative to each other (such as, for example, by hingedly joining the first sidewall 42 to the second sidewall 44 or supporting each independently from the other such that one is moveable independent of the other) in addition to being moveable relative to the third sidewall 46. The configuration of the illustrated example provides a stable arrangement that provides convenient access and establishes a desirable finish surface at the doorway 30. The exterior of the first sidewall 42 and the second sidewall 44 may be covered with any finished surface desired to be consistent with the building design.

The example enclosure 40 includes additional sidewalls 70, 72 and 74. The sidewalls 70 and 74 will not be exposed to elevator passengers when the example arrangement is installed at a landing 26. The sidewall 72 may be exposed and can have the same finished surface as the rest of the doorway 30 including the first sidewall 42 and second sidewall 44.

The example of FIG. 3 includes a stop surface 76 against which a portion of the second sidewall 44 is received when the enclosure 40 is closed. The stop surface 76 also includes a cushion member 78 against which an edge 80 of the door 38 is received. The cushion member 78 facilitates quiet door closures, for example.

In one example, the sidewalls 70, 72, 74 and the stop surface 76 are distinct pieces that are joined together when assembling the enclosure 40. In another example, the sidewalls 70, 72, 74 and the stop surface 76 are all formed from a single piece of material. In one such example, a single metal sheet is bent to form the sidewalls and the stop surface.

As best appreciated from FIG. 4, the second sidewall 44 has a thickness that is greater than a spacing between the edge 80 of the door 38 and the stop surface 76. This arrangement provides a finished, closed look when the door 38 is closed and the enclosure 40 is closed.

As can be appreciated from FIG. 3, even when the door 38 is in a fully closed position, the access opening 48 can be completely exposed by moving the first sidewall 42 and second sidewall 44 into the open position. This arrangement allows for maintaining isolation between the interior of the hoistway 24 and the building space at the landing 26 while performing a procedure involving access to any electronic components within the housing 40. Being able to keep the door 38 closed in this manner enhances efficiency and safety.

Another feature of the example shown in FIGS. 3 and 4 is a channel 84 supported on the third sidewall 46. The channel 84 is useful for guiding vertical movement of a door counterweight that facilitates proper operation and movement of the door 38. In some examples, a counterweight will not be used for the doors. In such an example, the channel 84 is replaced with another structure that facilitates providing a spring that is used for controlling door position or movement.

Another feature of the example shown in FIGS. 2-4 is the provision of a lock 90 that may be employed to retain the second sidewall 44 against the stop surface 76, thereby maintaining the enclosure 40 in an enclosed state. The lock 90 may include, for example, a keyhole 92, a pin 94 and a pin-engaging member 96. The keyhole 92 and the pin 94 may be provided on the second sidewall 44 whereas the pin-engaging member 96 may be provided on the stop surface 76. Of course, in other example embodiments the arrangement of the features of the lock 90 may be switched, moved, etc. Moreover, in other example embodiments the lock may not be visible from the landing 26 and may, for example, be locked and unlocked remotely in response to a wireless signal transmitted by a technician standing at the landing 26.

As can be appreciated from the above description, the example enclosure 40 provides convenient and effective access to control electronics supported within a door frame structure at a landing of an elevator system. The unique arrangement of the support surface 46' relative to the single access opening 48 increases the effective space within the enclosure 40 to facilitate access to and manipulation of components within the enclosure 40 without requiring the overall structure of the enclosure 40 or the corresponding door frame to be increased compared to conventional and aesthetically pleasing door frame designs.

In some examples, one enclosure 40 is provided on one side of the doorway and a second enclosure is provided on the other side of the doorway. In some examples, the enclosure 40 is provided on the large column side of the doorway to facilitate including more space within the enclosure 40 to house larger sized components such as batteries, for example.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. An enclosure for housing electronics useful with an elevator system, comprising:

a first vertically oriented sidewall;

a second vertically oriented sidewall adjacent the first sidewall; and a third vertically oriented sidewall at an oblique angle to the first sidewall when the enclosure is closed, the third sidewall providing a support surface for supporting the electronics inside the enclosure, the first and second sidewalls being moveable relative to the third sidewall to provide a single opening facing the support surface, the first, second and third sidewalls having a substantially equal vertical length, an interior space within the enclosure having a length coextensive with the vertical length of the sidewalls.

2. The enclosure of claim 1, wherein the first and second sidewalls remain in a fixed position relative to each other and are moveable together between an open position to provide the single opening and a closed position to close the enclosure.

3. The enclosure of claim 1, wherein the first and second sidewalls are pivotally moveable relative to the third sidewall.

4. The enclosure of claim 1, wherein the first and second sidewalls are formed from a single piece of material and the third sidewall is formed from another piece of material.

5. The enclosure of claim 4, wherein the single piece of material comprises a sheet of metal having a corner, the first sidewall is on one side of the corner and the second sidewall is on another side of the corner.

6. The enclosure of claim 1, wherein the enclosure has a length that is at least four times greater than a width of the enclosure.

7. The enclosure of claim 1, comprising a channel on an outside surface of the third sidewall, the channel being configured to guide a vertically moveable member along the channel.

8. The enclosure of claim 1, wherein the enclosure is configured to be housed within a jamb of a doorway for an elevator hoistway.

9. The enclosure of claim 1, wherein the first sidewall is generally perpendicular to the second sidewall.

10. An elevator doorframe assembly, comprising:

a header;

a first jamb member near a first end of the header;

a second jamb member near a second end of the header, the second jamb member comprising an enclosure for supporting elevator system electronics, the enclosure comprising a first vertically oriented sidewall, a second vertically oriented sidewall adjacent the first sidewall and a third vertically oriented sidewall that is obliquely oriented relative to the first sidewall when the enclosure is closed, wherein the first and second sidewalls are moveable relative to the third sidewall to provide a single access opening into the enclosure, the sidewalls each having a vertical length that is substantially equal to the vertical length of the other two sidewalls, the vertical length extending along a substantial portion of the second jamb member; and electronics supported on at least the third sidewall, the electronics being configured to provide control over at least inspection procedures for an associated elevator system, maintenance procedures for an associated elevator system, and passenger assistance procedures to assist passengers of an associated elevator system.

11. The assembly of claim 10, wherein the access opening is facing and opposite from the third sidewall.

12. The assembly of claim 10, wherein the first and second sidewalls remain in a fixed position relative to each other and are moveable together between an open position to provide the single access opening and a closed position to close the enclosure.

13. The assembly of claim 10, wherein the first and second sidewalls are pivotally moveable relative to the third sidewall.

14. The assembly of claim 10, wherein the first and second sidewalls are formed from a single piece of material and the third sidewall is formed from another piece of material.

15. The assembly of claim 14, wherein the single piece of material comprises a sheet of metal having a corner, the first sidewall is on one side of the corner and the second sidewall is on another side of the corner.

16. The assembly of claim 10, wherein the first sidewall is generally perpendicular to the second sidewall.

17. The assembly of claim 10, comprising a channel on an outside surface of the third sidewall, the channel being configured to guide a vertically moveable door counterweight along the channel.

18. The assembly of claim 10, wherein the second jamb member comprises a stop surface configured to contact a door and wherein the first sidewall is generally parallel to the stop surface when the first sidewall is in a position to close the single access opening.

19. The assembly of claim 18, wherein the first sidewall is received at least partially against the stop surface and the first sidewall has a thickness that is greater than a spacing between the stop surface and an adjacent door edge of the door when the door edge is received near the stop surface.

20. The assembly of claim 18, wherein the single access opening provides access to an inside of the enclosure from a landing side of the assembly when the door is received near the stop surface in a closed door position.

21. The assembly of claim 10, wherein the electronics comprise at least one of power control components;

elevator drive control components;

elevator car coordination components to receive and coordinate the response to elevator car calls and landing hall calls;

safety chain monitoring components;

communication components for communications with an interior of an associated elevator car; and a remote elevator monitoring module that is configured to communicate information regarding an associated elevator system to a remotely located device that is separate from the associated elevator system.

22. An elevator system, comprising an elevator car that is moveable within a hoistway; and a plurality of doorways at landings along the hoistway, each of the doorways having at least one door that is selectively open or closed to selectively provide access to the hoistway or the elevator car from the landing, at least one of the doorways including an electronics enclosure that houses electronics that are configured to control movement of the elevator car, the electronics enclosure being located on one side of the at least one doorway and comprising a first sidewall, a second sidewall adjacent the first sidewall and a third sidewall that is obliquely oriented relative to the first sidewall, the first and second sidewalls being moveable relative to the third sidewall to provide a single access opening facing the third sidewall for allowing access to the electronics from a landing side of the at least one doorway, wherein the enclosure comprises a stop surface configured to contact the at least one door of the at least one doorway, wherein the first sidewall is generally parallel to the stop surface when the first sidewall is in a position to close the single access opening and the first sidewall is received at least partially against the stop surface, and wherein the first sidewall has a thickness that is greater than a spacing between the stop surface and an adjacent door edge of the door when the door edge is received near the stop surface.

23. The system of claim 22, wherein the electronics are at least partially supported on the third sidewall and the single access opening is opposite from and facing the third sidewall.

24. The system of claim 22, wherein the first and second sidewalls of the enclosure are moveable between an open and closed position to selectively open or close the single access opening.

25. The system of claim 24, wherein the first and second sidewalls remain in a fixed position relative to each other and the first and second sidewalls move together between the open and closed positions.

26. The system of claim 22, comprising a channel on an outside surface of the third sidewall and a counterweight associated with the at least one door of the at least one doorway, the channel being configured to guide vertical movement of the door counterweight.

27. The system of claim 22, wherein the electronics are configured to provide control over at least inspection procedures for the elevator system, maintenance procedures for the elevator system, and passenger assistance procedures to assist passengers of the elevator system.

28. The elevator system of claim 27, wherein the electronics comprise at least one of power control components;

elevator drive control components;

elevator car coordination components to receive and coordinate the response to elevator car calls and landing hall calls;

safety chain monitoring components communication components for communications with an interior of the elevator car; and a remote elevator monitoring module that is configured to communicate information regarding the elevator system to a remotely located device that is separate from the elevator system.

* * * * *